United States Patent [19]

Hulswitt et al.

[11] Patent Number: 4,569,391

[45] Date of Patent: Feb. 11, 1986

[54] COMPACT HEAT EXCHANGER

[75] Inventors: Charles E. Hulswitt, Wooster; Donald D. Beam, Holmesville, both of Ohio

[73] Assignee: Harsco Corporation, Camp Hill, Pa.

[21] Appl. No.: 631,469

[22] Filed: Jul. 16, 1984

[51] Int. Cl.[4] ..... F28F 3/04

[52] U.S. Cl. ..... 165/166

[58] Field of Search ..... 165/166, 167

[56] References Cited

U.S. PATENT DOCUMENTS

| | | | |
|---|---|---|---|
| 785,580 | 3/1905 | Shiels et al. | 165/167 |
| 1,336,152 | 4/1920 | O'Shaughnessy . | |
| 1,826,344 | 10/1931 | Dalgliesh . | |
| 2,281,754 | 5/1942 | Dalzell | 165/167 |
| 2,306,526 | 12/1942 | Dalzell et al. | 165/166 |
| 2,361,691 | 10/1944 | Jendrassik | 257/245 |
| 2,619,329 | 11/1952 | Newhall | 165/167 |
| 3,211,219 | 10/1965 | Rosenblad | 165/166 |
| 3,255,817 | 6/1966 | Davids et al. | 165/166 |
| 3,463,222 | 8/1969 | Grames | 165/166 |
| 3,498,372 | 3/1970 | Patten et al. | 165/166 |
| 3,664,928 | 5/1972 | Roberts | 165/166 |
| 3,757,855 | 9/1973 | Kun et al. | 165/166 |
| 3,852,166 | 12/1974 | Palmason | 165/166 |
| 3,931,854 | 1/1976 | Ivakhnenko et al. | 165/166 |
| 4,002,201 | 1/1977 | Donaldson | 165/140 |
| 4,043,388 | 8/1977 | Zebuhr | 165/166 |
| 4,116,271 | 9/1978 | De Lepeleire | 165/166 |
| 4,219,080 | 8/1980 | Chaix et al. | 165/166 |
| 4,249,597 | 2/1981 | Carey | 165/166 |
| 4,293,033 | 10/1981 | Nasser | 165/166 |
| 4,310,960 | 1/1982 | Parker | 29/157.3 R |
| 4,384,611 | 5/1983 | Fung | 165/166 |

FOREIGN PATENT DOCUMENTS

| | | | |
|---|---|---|---|
| 156193 | 9/1983 | Japan | 165/166 |
| 827960 | 6/1979 | U.S.S.R. | 165/166 |

*Primary Examiner*—Sheldon J. Richter

*Attorney, Agent, or Firm*—Renner, Kenner, Greive & Bobak Co.

[57] ABSTRACT

A heat exchanger is formed by a plurality of parallel spaced plates (33,34,35,36) with the spaces between the plates defining fluid receiving passageways (38,39). Each plate includes protuberances (41,42,44,46,49,51) which are staggered with respect to the protuberances on each adjacent plate so that the protuberances of one plate rest against the adjacent plate between the protuberances thereof. Bars (43,48,52) are positioned on the periphery of each plate to close off the passageways and to permit the ingress and egress of a fluid at one temperature and a fluid at a second temperature through adjacent passageways.

8 Claims, 11 Drawing Figures

COMPACT HEAT EXCHANGER

TECHNICAL FIELD

This invention relates to a heat exchanger. More particularly, this invention relates to a compact heat exchanger for cooling or heating fluids, such as might be used to cool electronic equipment, which is highly efficient and sturdy.

BACKGROUND ART

There are a wide variety of known heat exchangers wherein fluids flow between plates to effect the desired heat transfer. Where high volume applications are involved, usually flat plates can be employed; however, use of such flat plates for volume purposes represents a sacrifice of the heat transfer abilities of the device.

In order to enhance the heat transfer characteristics of these types of devices, it is known to put some type of obstruction between the plates to cause the fluids to take a sinuous path therebetween. These obstructions are often in the form of a honeycomb structure which inherently have several problems. First, in the direction of flow there is usually a straight path through the heat exchanger thereby defeating the purpose of the obstructions. In addition, the sharp bends and corners in the honeycomb structure can create undesirable dead spots within the heat exchanger and also represent weak points or areas of deleterious stress concentration in the structure which, upon heating and cooling, will often crack.

In short, there is no prior art compact heat exchanger which can efficiently effect heat transfer through a structurally sturdy device.

DESCRIPTION OF THE INVENTION

It is therefore a primary object of the present invention to provide an extremely efficient and sturdy compact heat exchanger.

It is another object of the present invention to provide a heat exchanger, as above, with increased heat transfer characteristics by increasing the surface area of heat transfer plates without creating dead spaces between the heat transfer plates.

It is a further object of the present invention to provide a heat exchanger, as above, with increased turbulence between the heat transfer plates so that all the fluid can be exposed to the heat transfer plates.

It is still another object of the present invention to provide a heat exchanger, as above, in which the heat transfer plates totally nest with each other to provide a structurally stronger device by minimizing unsupported areas.

It is yet another object of the present invention to provide a heat exchanger, as above, with means which permit ingress and egress of fluid to alternate spaces between the heat transfer plates while at the same time close off the spaces between such plates.

It is still further object of the present invention to provide a heat exchanger, as above, wherein the ingress and egress of the fluid is positioned so that there is no path straight through the space between the plates.

These and other objects of the present invention, which will become apparent from the description to follow, are accomplished by the means hereinafter described and claimed.

In general, a plurality of parallel spaced plates form the compact heat exchanger, the spaces between the plates defining fluid receiving passageways. Each plate includes protuberances extending into the passageways with the protuberances on each plate being staggered with respect to the protuberances on each adjacent plate so that the protuberances of one plate rest against the adjacent plate between the protuberances thereof. Bars on the periphery of each plate are positioned to permit the ingress and egress of warm fluids and cool fluids through alternate adjacent passageways and at a position so that the protuberances are prohibiting a direct line flow of fluid between the point of ingress and the point of egress.

PREFERRED EMBODIMENT FOR CARRYING OUT THE INVENTION

Figure 1:
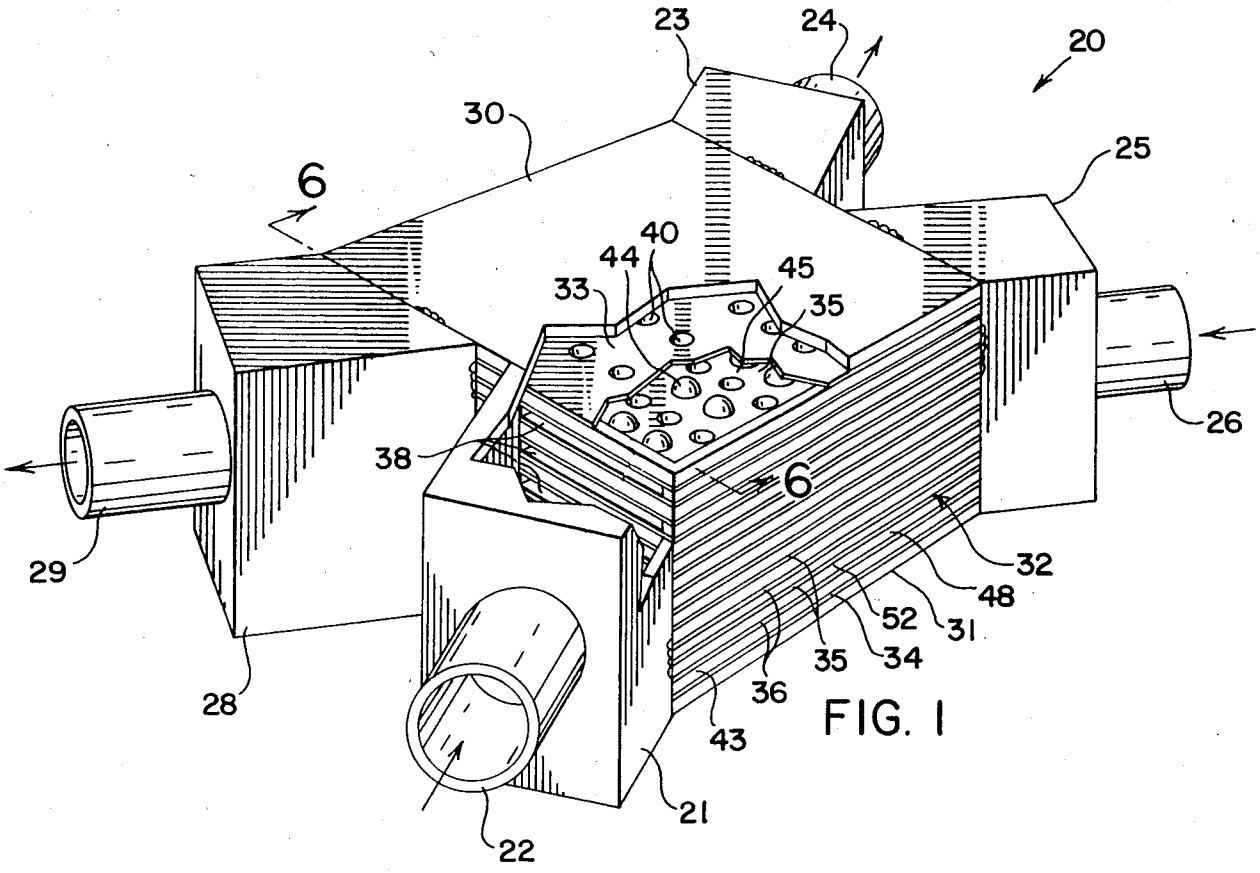
FIG. 1 is a perspective view of the heat exchanger according to the concept of the present invention having portions thereof broken away.

An embodiment of the compact heat exchanger according to the present invention is generally indicated by the numeral 20 in FIG. 1. It is generally shown as being rectangular or square in configuration but it should be appreciated that it could take on a variety of other common configurations. Heat exchanger 20 includes an input header 21 having an input coupling 22 to be attached to a source of fluid of one temperature, for example, a cooling fluid. The fluid could be a liquid or a gas as would be most appropriate to the particular circumstances. Input header 21 has a corresponding output header 23 and output coupling 24 for the egress of fluid entering through header 21. Heat exchanger 20 also includes a second input header 25 having an input coupling 26 to be attached to a second source of fluid of a second temperature, for example, a hot fluid to be cooled. Input header 25 has a corresponding output header 28 and output coupling 29 for the egress of fluid entering through header 25. Thus, as shown, the flow of fluid from header 21 to header 23, generally diagonally across heat exchanger 20, is angular to the flow of fluid from header 25 to header 28, generally along the other diagonal of heat exchanger 20, essentially setting up a cross-flow in heat exchanger 20. It should be appreciated, however, that if the heat exchanger were more rectangular in nature, as opposed to the generally square configuration shown herein, the flow, at least near the center thereof, would be essentially counterflow in nature.

Figure 3:
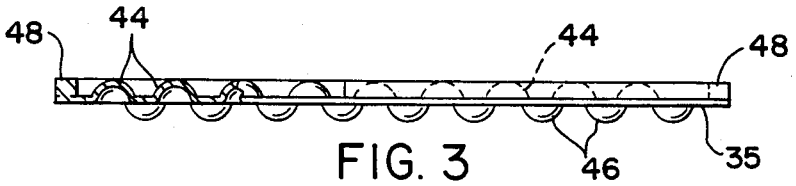
FIG. 3 is a detached edge view of another type of plate configuration employed in the heat exchanger according to the concept of the present invention, having a fragmentary break therein.
Figure 4:
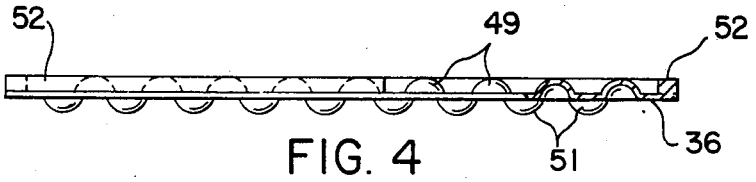
FIG. 4 is a detached edge view of another type of plate configuration employed in the heat exchanger according to the concept of the present invention, having a fragmentary break therein.

Headers 21, 23, 25 and 28 are affixed to a top plate 30 and bottom plate 31 thereby forming the body of heat exchanger 20. Affixed between plates 30 and 31 is the heat exchanging core generally indicated by the numeral 32. Heat exchanging core 32 includes a plurality of stacked plates, the particular number of which can vary depending on the particular heat exchange application involved. As shown herein, heat exchanging core 32 consists of four types of plates, a top plate 33 shown in FIG. 2, a bottom plate 34 shown in FIG. 5, and internal plates 35 (FIG. 3) and 36 (FIG. 4) which are alternatingly stacked between top plate 33 and bottom plate 34. It should be evident that for each application there will be one top plate 33 and one bottom plate 34 with the number of internal plates 35 and 36 varying depending on the application involved. All of the plates can be made of any type of heat conducting metal such as aluminum, titanium or the like, and, as will hereinafter become evident, are parallel to and spaced from each other to form heat exchanging core 32, the spaces between the plates alternately defining passageways for the warmer and cooler fluids, passageways 38 receiving fluid from header 21 and alternate adjacent passageways 39 receiving fluid from header 25, as depicted in FIG. 6.

Figure 2:
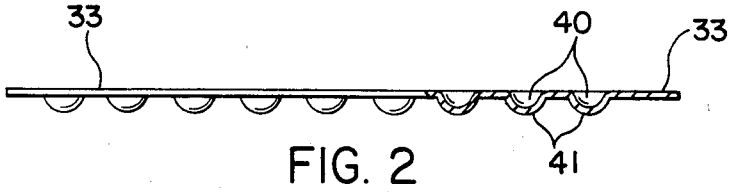
FIG. 2 is a detached edge view of one type of plate configuration employed in the heat exchanger according to the concept of the present invention, having a fragmentary break therein.
Figure 6:
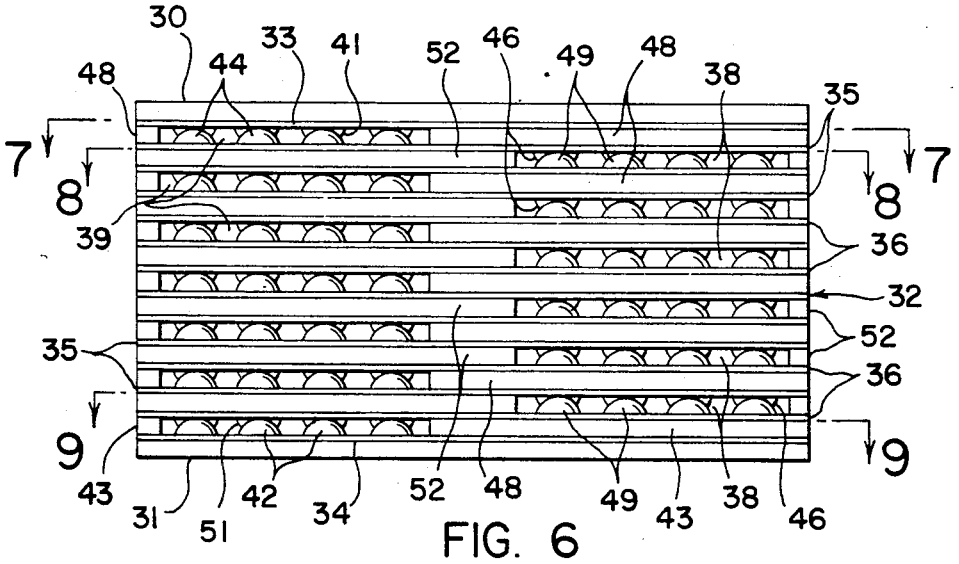
FIG. 6 is a view taken substantially along line 6—6 of FIG. 1.
Figure 7:
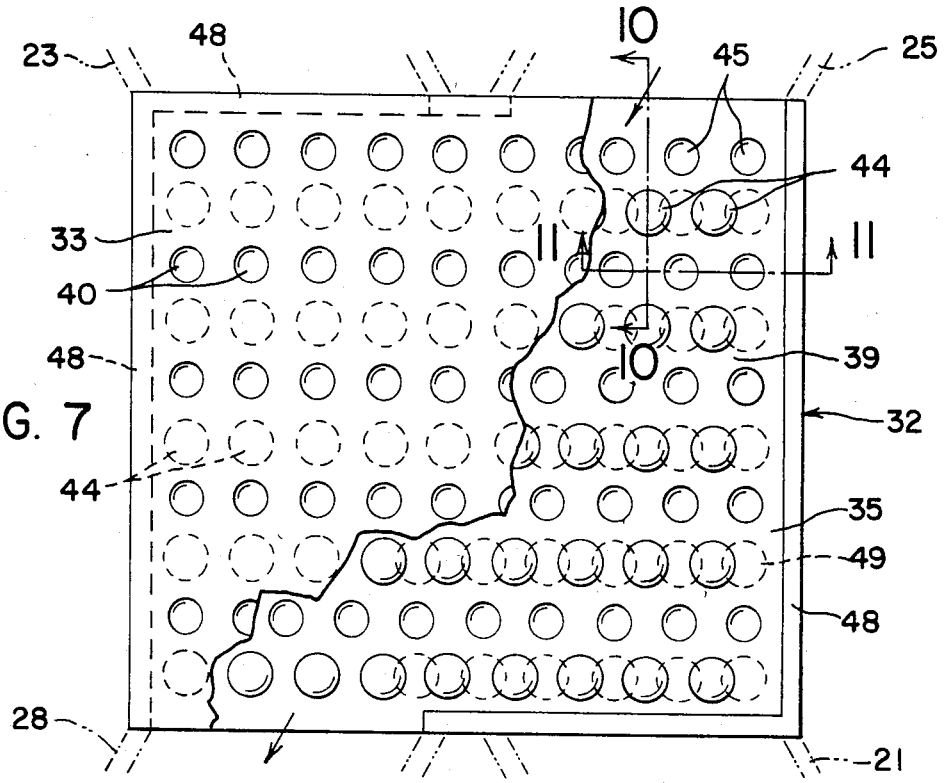
FIG. 7 is a partially broken away view taken substantially along line 7—7 of FIG. 6 and omitting some of the repetitive detail thereof.

As best shown in FIGS. 2 and 7, top plate 33 is formed with a plurality of depressions 40 in its upper surface with such depressions appearing as protuberances 41 extending into the uppermost passageway 39 as shown in FIG. 6. It should be noted that protuberances 41 are generally hemispherical in nature presenting smooth surfaces to the fluids passing through the passageways and, as will hereinafter become evident, adding structural strength to the device.

Figure 5:
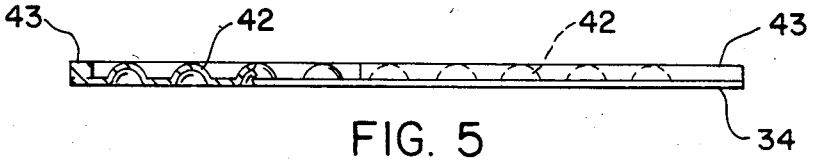
FIG. 5 is a detached edge view of another type of plate configuration employed in the heat exchanger according to the concept of the present invention, having a fragmentary break therein.
Figure 9:
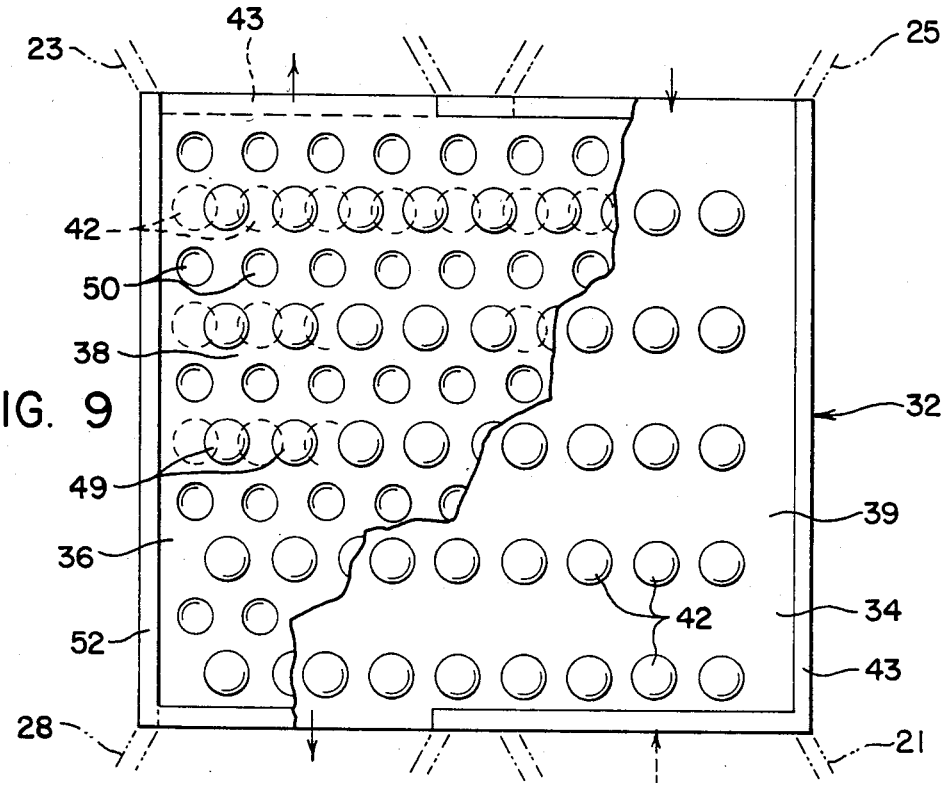
FIG. 9 is a partially broken away view taken substantially along line 9—9 of FIG. 6 and omitting some of the repetitive detail thereof.

Bottom plate 34 is best shown in FIGS. 5 and 9 as having a plurality of protuberances 42 which extend upwardly into the lowermost passageway 39 and which are identical in configuration to protuberances 41. Plate 34 is also provided with closure bars 43 extending upwardly around the periphery thereof leaving openings into lowermost passageway 39 for the ingress of fluid from header 25 and egress of fluid through header 28.

Internal plates 35 and 36 are alternately positioned between top plate 33 and bottom plate 34 with the number of plates 35 and 36 selected being variable dependent on the particular heat transfer application. As best shown in FIG. 7, the uppermost plate 35 is positioned parallel to and adjacent top plate 33. The upper surface of each plate 35 has a rectangular pattern of protuberances 44 formed therein identical in form to protuberances 41 on plate 33. Protuberances 44 of the uppermost plate 35 extend into the uppermost passageway 39 and are staggered with respect to protuberances 41 of plate 33 so that plate 33 and uppermost plate 35 can be conveniently nested together. It should be noted with reference to FIGS. 10 and 11 that the apexes of protuberances 41 rest against the flat surface of uppermost plate 35 between protuberances 44 thereof while at the same time the apexes of protuberances 44 rest against the flat surface of plate 33 between protuberances 41 thereof to provide a very sturdy structure.

The upper surface of each plate 35 is also provided with a plurality of depressions 45 formed in a rectangular pattern. Depressions 45 and protuberances 44 are staggered and together form a checkerboard type pattern on the upper surface of plates 35. Depressions 45 appear as protuberances 46 on the lower surface of each plate 35 which extend into passageways 38 and, in a manner to be hereinafter described, engage each plate 36.

Each plate 35 also includes closure bars 48 extending upwardly around the periphery thereof leaving openings into passageways 39 for the ingress of fluid from header 25 and egress of fluid through header 28.

Figure 8:
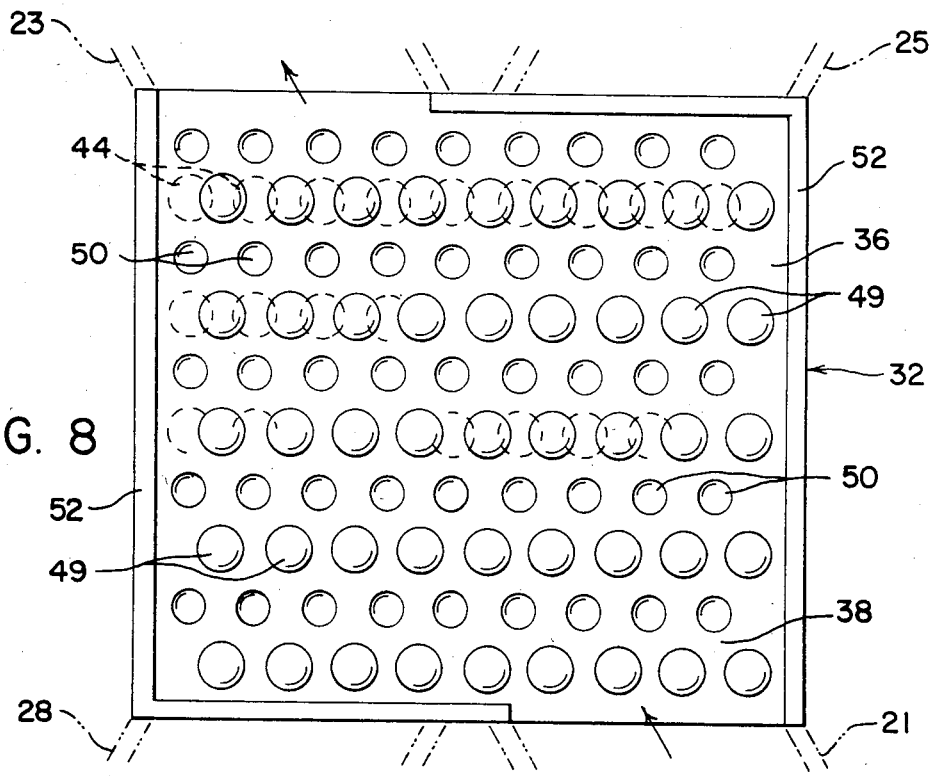
FIG. 8 is a view taken substantially along line 8—8 of FIG. 6 and omitting some of the repetitive detail thereof.
Figure 10:
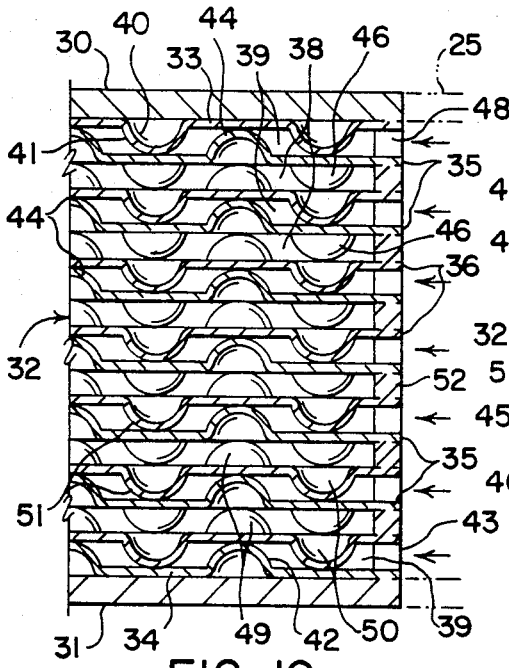
FIG. 10 is a sectional view taken substantially along line 10—10 of FIG. 7.
Figure 11:
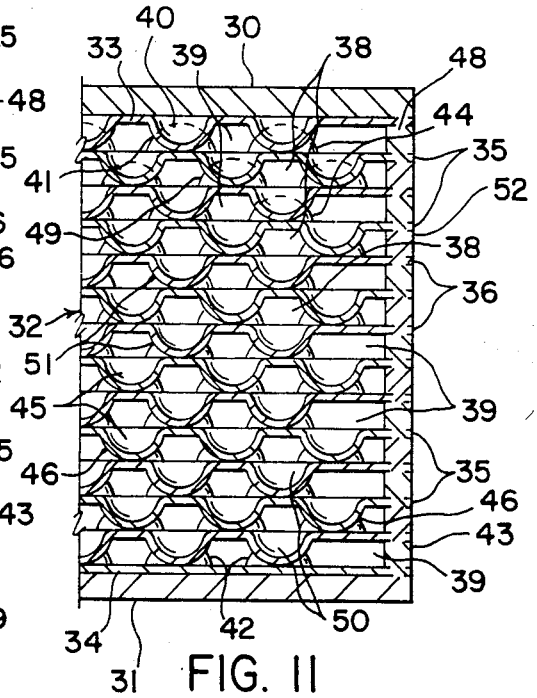
FIG. 11 is a sectional view taken substantially along line 11—11 of FIG. 7 and omitting some of the repetitive detail thereof.

As previously described, plates 36 alternate with plates 35 between top plate 33 and bottom plate 34, the uppermost plate 36 being underneath the uppermost plate 35 and the lowermost plate 36 being adjacent and above bottom plate 34. As best shown in FIG. 8, the upper surface of each plate 36 has a rectangular pattern of protuberances 49 formed therein identical in form to protuberances 41, 42, 44 and 46. Protuberances 49 extend into passageways 38 and are staggered with respect to protuberances 46 of plates 35 so that plates 36 and the plates 35 thereabove can be conveniently nested together. As shown in FIGS. 10 and 11, the apexes of protuberances 46 rest against the flat surface of plates 36 between protuberances 49 thereof while at the same time the apexes of protuberances 49 rest against the flat surface of plates 35 between protuberances 46 thereof to provide a very sturdy structure.

The upper surface of each plate 36 is also provided with a plurality of depressions 50 formed in a rectangular pattern. Depressions 50 and protuberances 49 are staggered and together form a checkerboard type pattern on the upper surface of plates 36. Depressions 50 appear as protuberances 51 on the lower surface of each plate which extend into passageways 39 and are staggered with respect to protuberances 44 of plates 35 so that plates 36 and the plates 35 therebelow can be conveniently nested together. As shown in FIGS. 10 and 11, the apexes of protuberances 44 rest against the flat surface of plates 36 between protuberances 51 thereof while at the same time the apexes of protuberances 51 rest against the flat surface of plate 35 between protuberances 44 thereof to provide a very sturdy structure.

Similarly, protuberances 51 of the lowermost plate 36 are staggered with respect to protuberances 42 of bottom plate 34 so that lowermost plate 36 and plate 34 can be conveniently nested together. Again as shown in FIGS. 10 and 11, the apexes of protuberances 51 of lowermost plate 36 rest against the flat surface of plate 34 between protuberances 42 thereof while at the same time the apexes of protuberances 42 rest against the flat surface of lowermost plate 36 between protuberances 51 thereof to provide a very sturdy structure.

Each plate 36 also includes closure bars 52 extending upwardly around the periphery thereof leaving openings into passageways 38 for the ingress of fluid from header 21 and egress of fluid through header 23.

Heat exchanger 20 is conveniently assembled by stacking the selected number of plates 35 and 36 together, placing a top plate 33 on the uppermost plate 35 and a bottom plate 34 under the lowermost plate 36, sliding the thus assembled core 32 between top plate 30 and bottom plate 31 so that the openings to passageways 38 and 39, defined by closure bars 43, 48 and 52, align with the headers 21, 23, 25 and 28, and welding the whole assembly together to form a sealed unit.

It should be evident that when fluids enter passageways 38 and 39 they are confronted with a unique pattern of interfering protuberances coming both downwardly from the plate above and upwardly from the plate below. The turbulence created as the fluids make their sinuous path from input to output greatly enhances the heat transfer characteristics of the device. In addition, the increased surface areas of the plates afforded by the protuberances and depressions also enhances the heat transfer characteristics. Furthermore, the fact that the rounded protuberances nest within each other and actually engage the adjacent plate gives the heat exchanger structural rigidity which permits the use of thinner metallic plate material to further enhance the heat transfer characteristics.

It is thus evident that a heat exchanger constructed according to the concept of the present invention substantially improves the art and otherwise accomplishes the objects of the invention.

We claim:

1. A compact heat exchanger, comprising:

a top plate, at least one first internal plate alternating with at least one second internal plate, and a bottom plate, all of said plates being positioned parallel to each other, the spaces between said plates defining fluid receiving passageways, said top plate being positioned adjacent a said first internal plate and having protuberances extending outwardly therefrom toward said first internal plate, said bottom plate being positioned adjacent a said second internal plate and having protuberances extending outwardly therefrom toward said second internal plate, each said first internal plate having protuberances extending outwardly therefrom both toward said top plate and toward a said second internal plate, said protuberances of said first internal plate which extend toward said top plate being staggered with respect to said protuberances of said top plate and being disposed in a pattern identical to said protuberances of said bottom plate, each of said protuberances of said first internal plate which extend toward a said second internal plate being displaced laterally and displaced in a direction transverse thereto from each of said protuberances of said first internal plate which extend toward said top plate, each said second internal plate having protuberances extending outwardly therefrom both toward said bottom plate and toward a said first internal plate, said protuberances of said second internal plate which extend toward said bottom plate being staggered with respect to said protuberances of said bottom plate and being disposed in a pattern identical to said protuberances of said top plate, each of said protuberances of said second internal plate which extend toward a said first internal plate being displaced laterally and displaced in a direction transverse thereto from each of said protuberances of said second internal plate which extend toward said bottom plate, said protuberances of said second internal plate which extend toward a said first internal plate being staggered with respect to said protuberances thereof, all of said protuberances being hemispherical in configuration and in generally rectangular patterns on said plates, and arranged so that the plates nest together with the protuberances on each said plate contacting each adjacent plate between the protuberances thereof, said bottom plate further having closure bars secured thereto about its periphery and extending toward a said second internal plate, said closure bars extending along the entire length of two opposite sides of said bottom plate and partially along the length of the other two opposite sides of said bottom plate to define ingress and egress points for a first fluid, each said first internal plate further having closure bars secured thereto about its periphery and extending toward said top plate, said closure bars extending along the entire length of two opposite sides of said first internal plate and partially along the length of the other two opposite sides of said first internal plate to define ingress and egress points for a first fluid, and each said second internal plate further having closure bars secured thereto about its periphery and extending toward a said first internal plate, said closure bars extending along the entire length of two opposite sides of said second internal plate and partially along the length of the other two opposite sides of said second internal plate to define ingress and egress points for a second fluid.

2. A compact heat exchanger according to claim 1 further comprising a first input header secured to the heat exchanger and fluidly communicating with each said ingress point for a first fluid; a first output header secured to the heat exchanger and fluidly communicating with each said egress point for a first fluid; a second input header secured to the heat exchanger and fluidly communicating with each said ingress point for a second fluid; and, a second output header secured to the heat exchanger and fluidly communicating with each said egress point for a second fluid.

3. A compact heat exchanger according to claim 2 wherein said closure bars of each said plate are welded to the next adjacent said plate and said headers are welded to the heat exchanger such that a sealed unit is formed.

4. A compact heat exchanger according to claim 3, said plates having depressions in one side thereof at the location where said protuberances extend outwardly from the other side thereof.

5. A compact heat exchanger according to claim 4 wherein the space on said plates between said protuberances is generally flat.

6. A compact heat exchanger according to claim 5 wherein said plates are generally rectangular.

7. A compact heat exchanger according to claim 6 wherein the location of the ingress and egress of the fluids is adjacent each corner of said plates.

8. A compact heat exchanger according to claim 7 wherein the ingress of each fluid is at a location diagonally opposite its egress generally creating a cross-flow of fluids in adjacent passageways.

* * * * *